US005521677A

United States Patent [19]

Brewington et al.

[11] Patent Number: 5,521,677

[45] Date of Patent: May 28, 1996

[54] METHOD FOR SOLID AREA PROCESS CONTROL FOR SCAVENGELESS DEVELOPMENT IN A XEROGRAPHIC APPARATUS

[75] Inventors: Grace T. Brewington, Fairport; Richard P. Germain, Webster, both of N.Y.

[73] Assignee: Xerox Corporation, Stamford, Conn.

[21] Appl. No.: 497,834

[22] Filed: Jul. 3, 1995

[51] Int. Cl.[6] ..... G03G 15/06

[52] U.S. Cl. ..... 355/208; 355/246; 355/259; 118/688; 118/653

[58] Field of Search ..... 355/246, 208, 355/245, 259; 118/688–691, 653–658

[56] References Cited

U.S. PATENT DOCUMENTS

| | | | |
|---|---|---|---|
| 3,348,522 | 10/1967 | Donohue . | |
| 4,318,610 | 3/1982 | Grace | 355/14 D |
| 4,372,672 | 2/1983 | Pries | 355/246 X |
| 4,466,731 | 8/1984 | Champion et al. | 355/246 |
| 4,553,033 | 11/1985 | Hubble, III et al. | 250/353 |
| 5,010,368 | 4/1991 | O'Brien | 355/259 |
| 5,063,875 | 11/1991 | Folkins | 118/651 |
| 5,322,970 | 6/1994 | Behe et al. | 118/651 |
| 5,410,388 | 4/1995 | Pacer et al. | 355/208 |

*Primary Examiner*—R. L. Moses

*Attorney, Agent, or Firm*—H. Fleischer; J. E. Beck; R. Zibelli

[57] ABSTRACT

A solid area process control for scavengeless development using a transport roll-to-donor roll DC bias as a control parameter in an electrophotographic printing machine is disclosed. The process develops a latent image of a solid area toner patch on a photoconductive belt. Once the patch is developed, the patch is measured with an infrared reflectance type sensor. The measured development mass is compared to a target value stored in the machine memory. A test of the comparison is performed by the process. If the result of the test is less than the target value, the transport roll-to-donor roll bias is increased and the process ends. If the result is more than the target value, the transport roll-to-donor roll bias is decreased and the process ends, otherwise the process stops because the measured development is acceptable. The process is run at predetermined intervals to maintain constant output from the electrophotographic printing machine.

17 Claims, 4 Drawing Sheets

METHOD FOR SOLID AREA PROCESS CONTROL FOR SCAVENGELESS DEVELOPMENT IN A XEROGRAPHIC APPARATUS

This invention relates to a developer apparatus for electrophotographic printing. More specifically, the invention relates to a solid area process control for scavengeless development using a transport roll-to-donor roll DC bias as the control parameter.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member such as paper, and the image affixed thereto to form a permanent record of the image to be reproduced. Subsequent to development, excess toner left on the charge retentive surface is cleaned from the surface. The process is useful for light lens copying from an original document or for printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on the photoreceptor, the electrostatic charge on the photoreceptor will cause the toner particles to be pulled off the carrier beads and onto the photoreceptor.

An important variation to the general principle of development is the concept of "scavengeless" development. In a scavengeless development system, toner is detached from a donor roll by applying an AC electric field to self-spaced electrode structures, commonly in the form of wires positioned in the nip between a donor roll and photoreceptor. This forms a toner powder cloud thereto. Because there is no physical contact between the development apparatus and the photoreceptor, scavengeless development is useful for devices in which different types of toner are supplied onto the same photoreceptor such as in "tri-level", "recharge, expose and develop", "highlight", or "image on image" color xerography.

With all development systems it is desirable to identify a control parameter for closed loop feedback control of solid area development. For rapid response, image potential or the DC bias on the developer roll, or the donor roll may be used to control solid area development. However, image potential or the DC bias on the donor roll can affect the modulation transfer function. Fine lines and low density halftones will lose density faster than solid areas.

Toner concentration is another important parameter since the slope of the development curve typically increases as toner concentration increases. Although toner concentration is an important control parameter, its response is slower than bias changes. Toner concentration is also constrained by adequate print background at the high end, and by sufficient reload at the low end.

Thus, the advantages for using the developer roll-to-donor roll bias as a control parameter for solid area process control with scavengeless development is its rapid response and ease of implementation.

The rate of delivering toner to the photoreceptor is equal to the mass per unit area requirement for continuous solid areas such that all or nearly all toner delivered to the photoreceptor is developed onto the latent image. For the case of operating at or near the toner supply limit of development, decreasing the developer roll-to-donor roll bias has the effect of decreasing solid area development with relatively little effects on fine lines, low density halftones, and the tone reproduction curve. With most development systems, operation at the toner supply limit is not desirable because fluctuations in the toner mass area supplied to the donor roll readily show up as density variations. However for scavengeless development, operating at the donor roll supply limit is preferred so as to decrease toner-to-electrode wire interactions. With adequate uniformity within the developer housing, and because of the independent toner cloud about each electrode wire, performance at the toner supply limit is acceptable. Given the current materials comprising toner and carrier particles, the transport roll-to-donor roll bias can be operated over a wide range extending from −20 volts DC to −125 volts DC (referenced to the donor DC bias) with good results.

Controlling solid area development with a parameter of development is preferred over adjusting charge potential and exposure for maintaining the reproduction of fine lines and low density halftones.

The following disclosures may be relevant to various aspects of the present invention.

U.S. Pat. No. 3,348,522

Patentee: James M. Donohue

Issued: Oct. 24, 1967

U.S. Pat. No. 4,318,610

Patentee: Robert E. Grace

Issued: Mar. 9, 1982

U.S. Pat. No. 4,553,033

Patentee: Hubble III et al.

Issued: Nov. 12, 1985

U.S. Pat. No. 5,322,970

Patentee: Behe et al

Issued: Jun. 21, 1994

U.S. Pat. No. 5,410,388

Patentee: Pacer et al.

Issued: Apr. 25, 19955

U.S. patent application No. 08/228,787

Applicant: Guru B. Raj.

Filed: Apr. 18, 1994

The disclosures of the above-identified patents may be briefly summarized as follows U.S. Pat. No. 3,348,522 describes a device which exposes a stripe along the edge of a charged photoconductive drum. The stripe is developed with toner particles. A fiber bundle directs light rays onto the developed stripe and the bare surface of the photoconductive drum. A first photocell detects the light rays reflected from the developed stripe. A second photocell detects light rays reflected from the bare photoconductive surface. The first and second photocells form two legs of a bridge circuit used to control toner dispensing.

U.S. Pat. No. 4,318,610 discloses a control system for controlling photoreceptor charging and toner particle concentration within the developer mixture of an electrophotographic printing machine. Two test area images are developed in the interdocument area of the photoreceptor. Toner particles deposited on the first test area have a greater density than the toner particles deposited on the second test area. An infrared densitometer measures the density of the two test areas and additionally measures the bare surface of the photoreceptor. A controller forms ratios of the test mass area measurements to the bare photoreceptor surface measurements and generates proportional electrical error signals. The first error signal, in response to the first test area, controls a high voltage power supply to maintain a constant charge level on the photoreceptor surface. The second error signal, in response to the second test area, controls the dispensing of toner particles in the developer mixture.

U.S. Pat. No. 4,553,033 discloses an infrared densitometer for measuring the density of toner particles on a photoconductive surface. A tonal test patch is projected by a test patch generator onto the photoconductive surface. The patch is then developed with toner particles. Infrared light is emitted from the densitometer and reflected back from the test patch. Control circuitry, associated with the densitometer, generates electrical signals proportional to the developer toner mass of the test patch.

U.S. Pat. No. 5,322,970 describes a scavengeless development system which includes within a developer housing: a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. In the development zone, which is a nip located between the donor roll and the photoreceptor, are wires forming the electrode structure. During development of the latent image on the photoreceptor, the electrode wires are AC-biased relative to the donor roll to detach toner from the donor roll so as to form a toner cloud in the development zone. The latent image on the photoreceptor attracts toner particles from the powder cloud forming a toner image on the photoreceptor.

U.S. Pat. No. 5,410,388 discloses a control system for maintaining a constant large solid area development in the xerographic process by automatically adjusting charge on a photoreceptor and bias on a developer. A test patch is developed in the interdocument area of the photoreceptor. The density of both the lead and trailing edge of the test patch is measured with an infrared densitometer. A first determination is made as to whether or not the lead edge density is less than the trail edge density. If it is, then no adjustment is made. However, if the lead edge density is not less than the trail edge density, then one corrective action from three possible actions is accomplished based on the result of further determinations. Thus, a second determination decides whether or not the cleaning field potential is greater or equal to a reference potential. If it is, then a first corrective action proportionally decreases both the developer bias and the photoreceptor charge voltage. When the cleaning field potential is not greater or equal to a reference potential, a third determination is made as to whether the cleaning field potential is less than or equal to a reference potential. If it is, then a second corrective action will adjust the developer bias voltage. Finally, when the cleaning field potential is correct, with respect to the reference, a third corrective action will decrease the photoreceptor charge voltage.

U.S. patent application Ser. No. 08/228,787 describes an adaptive control system in an electrophotographic printing machine. A toner area coverage sensor located adjacent to the development zone detects density values for a composite toner image developed on the photoreceptor. The composite image represents the solid area, highlight density, and half-tone density of a tone reproduction curve. Corresponding output signals are generated by the sensor and conveyed to a linear quadratic controller. The controller compares the sensor signals to target image parameters and generates control signals based upon the difference between the two sets of inputs to correct development bias. An identifier also receives the signals generated by the sensors, along with the control signals and modifies the target images to compensate for changes in image quality due to material aging or environmental changes.

In accordance with one aspect of the invention, there is provided an apparatus for developing a latent image on a surface. The apparatus includes a donor member spaced from the surface, in a development zone, for transporting toner particles to the development zone. A transport member is positioned adjacent to the donor member in a loading zone. The transport member transports developer material comprising carrier granules having toner particles adhering triboelectrically thereto, to the loading zone. Means are included for forming an electrical bias between the transport member and the donor member. The electrical bias attracts toner particles from the carrier granules to the donor member in the loading zone. A sensor detects density of an image developed on the surface. A controller coupled to the sensor, generates a control signal as a function of the detected image. The controller being coupled to the forming means, regulates the electrical bias between the donor member and the transport member.

In accordance with another aspect of the invention, there is provided an electrophotographic printing machine of the type having a latent image recorded on a photoconductive member with a developer unit developing the latent image. The improvement includes a donor member spaced from the surface, in a development zone, for transporting toner particles to the development zone. A transport member is positioned adjacent to the donor member in a loading zone. The transport member transports developer material comprising carrier granules having toner particles adhering triboelectrically thereto, to the loading zone. Means are included for forming an electrical bias between the transport member and the donor member. The electrical bias attracts toner particles from the carrier granules to the donor member in the loading zone. A sensor detects density of an image developed on the surface. A controller coupled to the sensor, generates a control signal as a function of the detected image. The controller being coupled to the forming means, regulates the electrical bias between the donor member and the transport member.

In accordance with yet another aspect of the invention, there is provided a method of developing a latent image recorded on a surface. The method comprises transporting toner particles to a development zone with a donor member spaced from the surface in the development zone. Developer material comprising carrier granules having toner particles adhering triboelectrically thereto is transported to a loading zone with a transport member positioned adjacent the donor member in the loading zone, forming an electrical bias between the transport member and the donor member so as to attract toner particles from the carrier granules to the donor member in the loading zone. The density of an image developed on the surface is sensed and a control signal is generated as a function of detected density for regulating the electrical bias between the donor member and the transport member with a controller coupled to the sensor.

FIG. 1 is an elevational view of a printing machine in which the present invention can be used;

Figure 2:
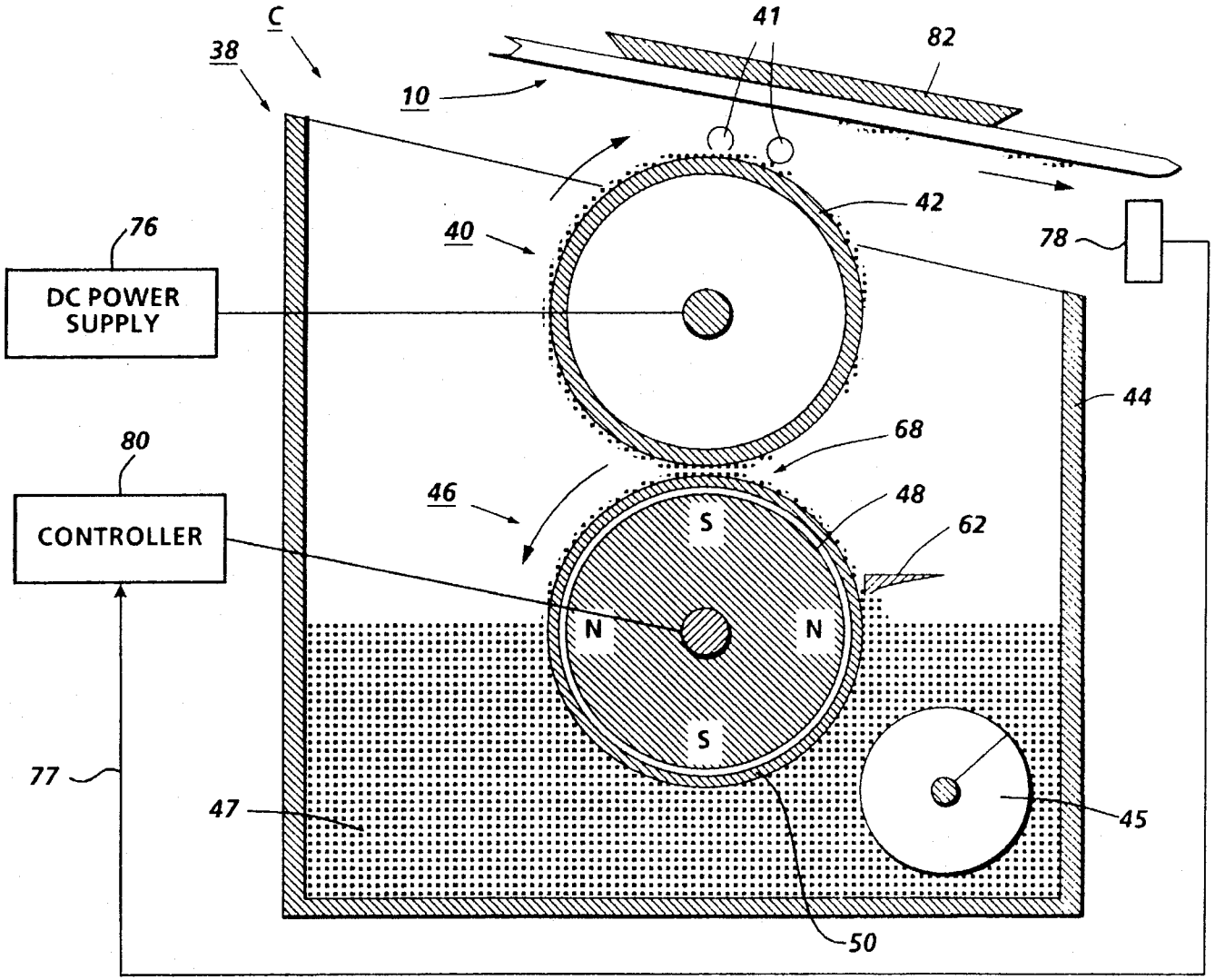
FIG. 2 is an elevational view of a scanvengeless development system incorporating a solid area process control system.
Figure 2:
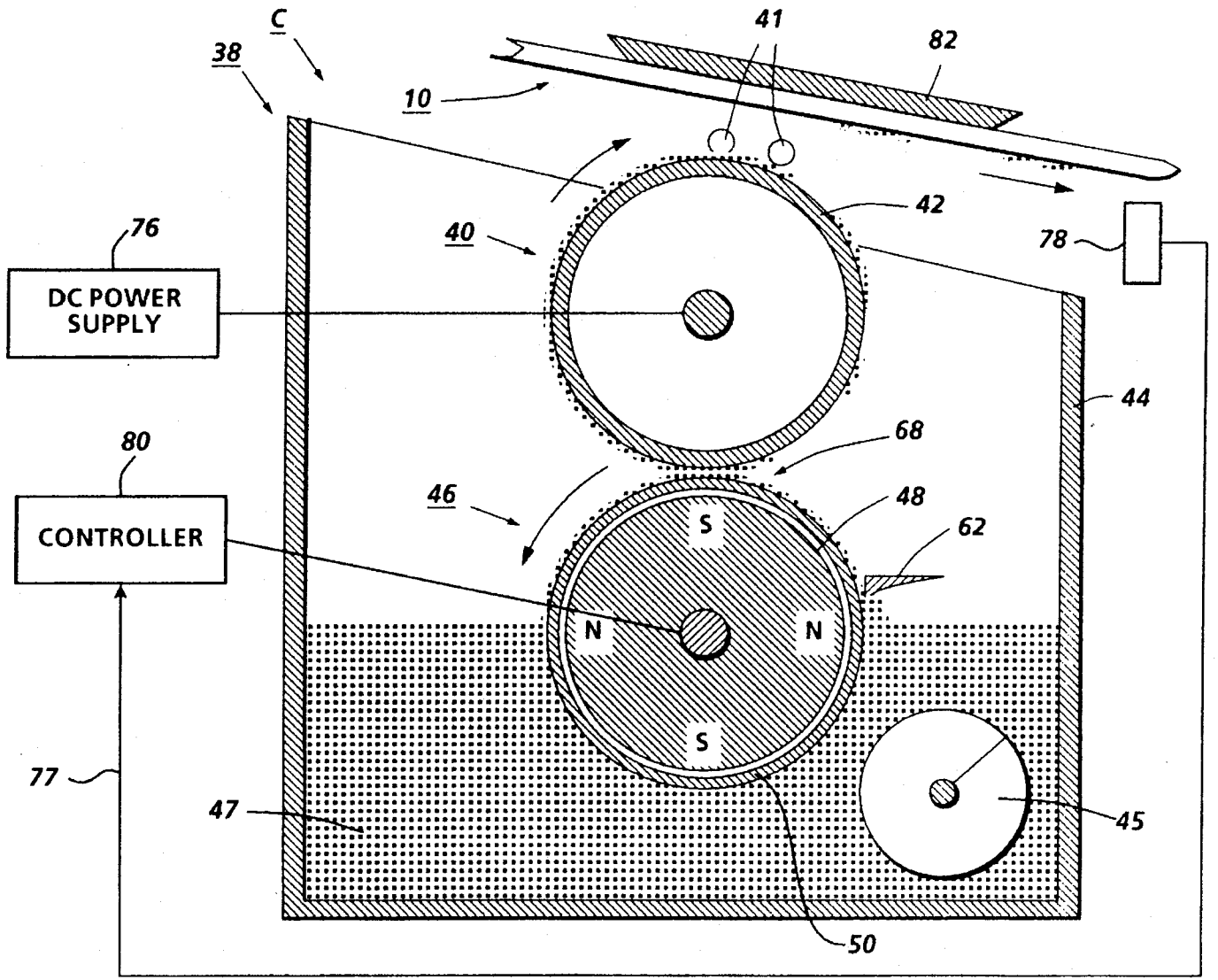

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the solid area process control for scavengeless development of the present invention therein. It will become evident from the following discussion that this control system is equally well suited for use in a wide variety of printing machines and is not necessarily limited i n its application to the particular embodiment depicted herein.

Turning to FIG. 1, the printing machine employs a photoreceptor 10 in the form of a belt having a photoconductive surface layer 12 on an electroconductive substrate 14. Preferably the surface 12 is made from an organic photoconductive material. The substrate 14 is preferably made from an aluminum overcoated polymer which is electrically grounded. Other suitable photoconductive surfaces and conductive substrates may also be employed. The belt 10 is driven by means of motor 24 along a path defined by rollers 18, 20, and 22 in a counterclockwise direction as shown by arrow 16. Initially, a portion of belt 10 passes through a charging station A at which a corona generator 26 charges surface 12 to a relatively high, substantially uniform potential. A high voltage power supply 28 is coupled to device 26. After charging, the charged area of surface 12 is passed to exposure station B.

At exposure station B, a Raster Input Scanner (RIS) and a Raster Output Scanner (ROS) are used to expose the charged portions of belt 10 to record an electrostatic latent image thereon. The RIS (not shown), contains document illumination lamps, optics, a mechanical scanning mechanism and photosensing elements such as charge coupled device (CCD) arrays. The RIS captures the entire image from the original document and converts it to a series of raster scan lines. These raster scan lines are transmitted from the RIS to a ROS 36. ROS 36 illuminates the charged portion of belt 10 with a series of horizontal lines with each line having a specific number of pixels per inch. These lines illuminate the charged portion of the belt 10 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. The ESS (not shown) is the control electronics for the ROS 36 and may be a self-contained, dedicated minicomputer. Thereafter, belt 10 advances the electrostatic latent image recorded thereon to development station C.

One skilled in the art will appreciate that a light lens system may be used instead of the RIS/ROS system heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. This records an electrostatic latent image on the photoconductive belt which corresponds to the informational areas contained within the original document disposed upon the transparent platen.

At development station C, a development system 38, develops the latent image recorded on the photoconductive surface 12. Preferably, development system 38, includes a donor roll 40 and electrode wires 41 positioned in the gap between the donor roll 40 and photoconductive belt 10. Electrode wires 41 are electrically biased relative to donor roll 40 to detach toner therefrom so as to form a toner powder cloud in the gap between the donor roll and photoconductive surface. The latent image attracts toner particles from the toner powder powder cloud forming a toner powder image thereon. A specific embodiment of development system 38 will be discussed hereinafter, in greater detail, with reference to FIG. 2.

Again referring to FIG. 1, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the front of sheet 54. As the belt turns around roller 18, the sheet is stripped therefrom with the toner image thereon.

After transfer, the sheet is advanced by a conveyor (not shown) to fusing station E. Fusing station E includes a heated fuser roller 64 and a backup roller 66. The sheet passes between fuser roller 64 and backup roller 66 with the toner powder image contacting fuser roller 64. In this manner, the toner powder image is permanently affixed to the sheet. After fusing, the sheet advances through chute 70 to catch tray 72 for subsequent removal from the printing machine by the operator.

Invariably, after the sheet is separated from photoconductive surface 12 of belt 10, some residual toner particles remain adhering thereto. These residual particles are removed from photoconductive surface 12 at cleaning station F. Cleaning station F includes a preclean corona generating device (not shown) and a rotatably mounted fibrous brush 74 in contact with photoconductive surface 12. The preclean corona generator neutralizes the charge attracting the particles to the photoconductive surface. These particles are cleaned from the photoconductive surface by the rotation of brush 74 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

Referring now to FIG. 2, there is shown a scavengeless development system 38 in greater detail. Housing 44 defines a chamber for storing a supply of developer material 47 therein. The developer includes carrier granules having toner particles adhering triboelectrically thereto. Positioned in the bottom of housing 44 is a horizontal auger 45 which distributes developer material uniformly along the length of transport roll 46 in the chamber of housing 44.

Transport roll 46 comprises a stationary multi-pole magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields causes developer material to be attracted to the exterior of the sleeve. A doctor blade 62 meters the quantity of developer adhering to sleeve 50 as it rotates to the loading zone comprised of a nip 68 located between transport roll 46 and donor roll 40. The donor roll is kept at a specific voltage, by a DC power supply 76. The output voltage from the DC power supply applies an electrical bias on donor roll 40 so as to attract a layer of toner particles from transport roll 46 in the loading zone and to suppress the development of toner in nonimage areas.

Transport roll 46 is biased by controller 80 having both an adjustable DC voltage and a fixed AC voltage from an AC/DC power supply contained therein. The effect of the DC bias is to enhance the attraction of toner particles in developer material 47 on sleeve 50 to donor roll 40. The AC bias loosens the toner particles from their triboelectric bonds to the carrier particles. Thus, it is the DC bias that affects the mass per unit area deposition of toner particles from transport roll 46 to donor roll 40.

Electrode wires 41 are disposed in the space between the belt 10 and donor roll 40. The electrode wires 41 extend in a direction substantially parallel to the longitudinal axis of the donor roll 40. An AC electrical bias is applied to electrode wires 41 by a voltage source (not shown) which establishes an alternating electrostatic field between electrode wires 41 and the donor roll 40. The electrostatic field causes toner to detach from the surface of donor roll 40 and form a toner cloud about electrode wires 41, the height of the cloud being such as to not contact belt 10.

At the development zone defined as the region where belt 10 passes closest to donor roll 40, a stationary shoe 82 bears on the inner surface of belt 10. The position of shoe 82 establishes the spacing between the donor roll 40 and belt 10. The position of the shoe is adjustable and is positioned so that the spacing between donor roll 40 and belt 10 is approximately 0.4 millimeters.

Sensor 78 is a toner area coverage (TAC) sensor used to detect a measure of solid area developability. An output signal from TAC sensor 78 is then processed to adjust the transport roll DC bias voltage until the solid area developability is within an acceptable level. TAC sensor 78, which is located after development system 38, is an infrared reflectance type sensor that measures the developed mass per unit area (DMA) of a black or colored solid area toner patch on belt 10. The output signal from TAC sensor 78 is conveyed to controller 80 by conductor 77 as a feedback signal.

Figure 3:
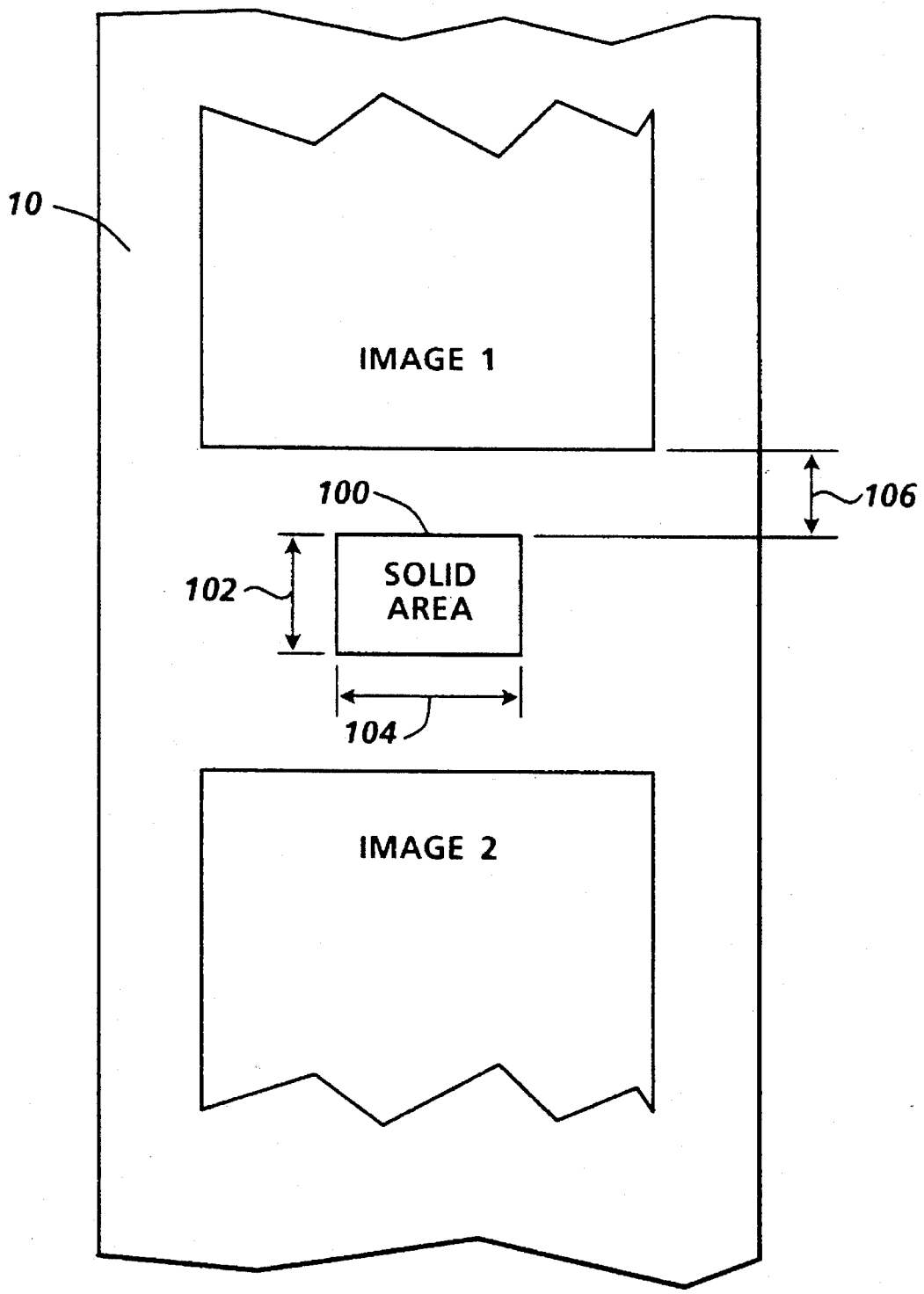
FIG. 3 shows the target area interposed between adjacent images recorded on the photoconductive member.

Referring to FIG. 3, a solid area density toner patch 100 is imaged in the interdocument area of belt 10. Belt 10 is shown having two document images: image 1 and image 2. Toner patch 100 is positioned in the interdocument space between image 1 and image 2 and is that portion of belt 10 sensed by TAC sensor 78 to provide the necessary signals for solid area development control. Toner patch 100 measures 15 millimeters, in the process direction, indicated by arrow 102 and 45 millimeters, in the cross process direction, indicated by arrow 104. Before TAC sensor 78 can provide a meaningful response to the relative reflectance of toner patch 100, it must be calibrated by measuring the light reflected from a bare or clean area portion 106 of belt 10. For calibration purposes, current to the light emitting diode (LED) internal to the TAC sensor 78 is increased until the voltage generated by the TAC sensor 78 in response to light reflected from the bare or clean area 106 is between 3 and 5 volts.

Referring to FIG. 1 and FIG. 3, a bit pattern for the toner patch 100 is computer generated during the design stage of the printing machine. The bit pattern is downloaded to a programmable read only memory (PROM) contained in a video module (Not Shown) of the ROS 36. Patch 100 is imaged in the interdocument zone of belt 10 by the ROS 36 at a rate of one patch per revolution of belt 10. The video module sends the bit pattern information to ROS 36. The ROS 36 changes exposure intensity pixel by pixel, so that the intensity variation of the individual pixels correspondingly changes the discharge potential on belt 10 and forms a latent image of toner patch 100. As belt 10 passes development station C, the latent image is developed with toner material. After development, the TAC sensor 78 detects the intensity of the light reflected from the clean area 106 of belt 10 and the toned area of patch 100. The change in reflectance between the clean area 106 and the toned area of patch 100 forms a relative reflectance reading that is a measure of the developed toner mass for patch 100. Readings generated by the TAC 78 sensor are then transmitted to controller 80.

At controller 80, the feedback signal from TAC sensor 78 is compared to a target solid area development value stored in the printing machine memory. The result of the comparison, i.e. whether solid area development is too high or too low, causes controller 80 to adjust the DC bias on transport roll 46 so as to affect the toner mass per unit area deposited on donor roll 40. Thus, for a given image potential and donor roll DC bias, and if, for example, the measured solid area density is too high, controller 80 reduces the DC bias on transport roll 46 to reduce the mass per unit area.

The advantages for using the transport roll-to-donor roll bias as a control parameter for solid area process control with scavengeless development is its rapid response and ease of implementation. For the case of operating at or near the toner supply limit of development, decreasing the transport roll-to-donor roll bias has the effect of decreasing solid area development with relatively little effects on fine lines, low density halftones, and the tone reproduction curve. With most development systems, operating at the toner supply limit is not desirable because fluctuations in the toner mass per unit area supplied to the donor roll readily show up as density variations. For scavengeless development, operating at the donor roll supply limit is preferred so as to decrease toner-to-electrode wire interactions. With adequate uniformity within the housing, and because of the independent toner cloud about each electrode wire, performance at the toner supply limit is acceptable. Given the current materials comprising toner and carrier particles, the transport roll-to-donor roll bias can be operated over a wide range extending from −20 volts DC to −125 volts DC with good results.

Controlling solid area development with a parameter of development is preferred over adjusting charge potential and exposure for maintaining the reproduction of fine lines and low density halftones. An algorithm for performing the development control may be included in the printing machine software.

Figure 4:
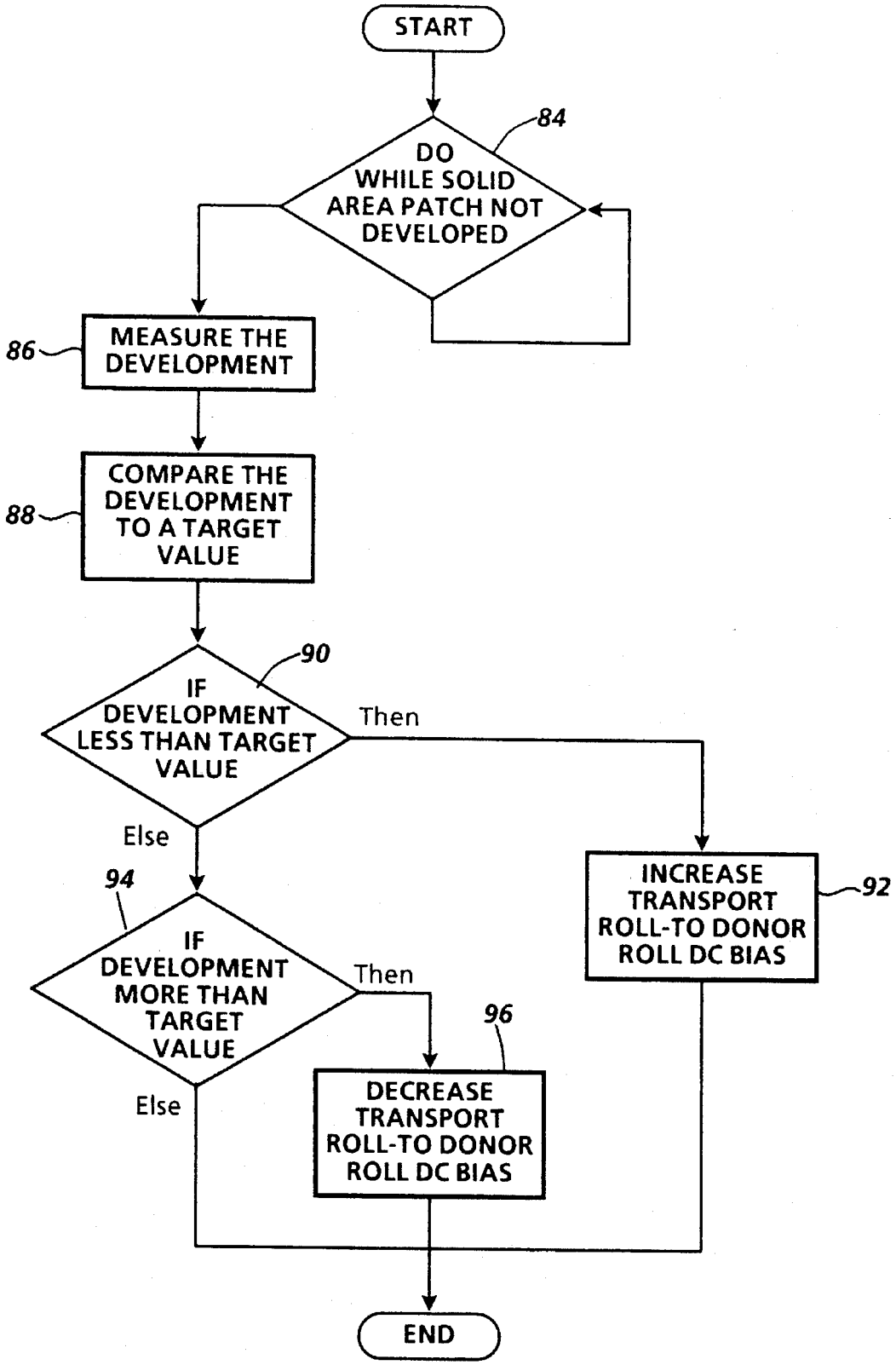
FIG. 4 is a flow diagram of an algorithm for the FIG. 2 control system in accordance with the present invention of controlling scanvengeless development.

FIG. 4 is a flow chart illustrating the step-by-step procedure of an algorithm for controlling scavengeless development with the present invention. Starting at step 84, the algorithm loops indefinitely until the latent image of the solid area toner patch is developed on the photoreceptor. Once the patch is developed, control is passed to step 86 wherein development of the patch is measured with an infrared reflectance type sensor. Next, the algorithm begins to test the measured development. At step 88, the measure of development obtained at step 86 is compared to a target value stored in memory. If, at step 90, the result of the comparison, at step 88, is less than the target value, then the transport roll-to-donor roll bias is increased at step 92 and the process ends. If the result, at step 90, is not less than the target value, the process continues to test the measured development at step 94.

At step 94, the process again tests the result obtained at step 88. If the result is more than the target value, then the transport roll-to-donor roll bias is decreased at step 96 and the process ends, else the process branches to the end because the comparison at step 88 is acceptable. Signal averaging over several cycles of the photoreceptor belt may be desirable. The algorithm is run at predetermined intervals to maintain constant output from the electrophotographic printing machine.

It will be obvious to one skilled in the art that the present invention may be used in other development systems having a transport roll that loads a donor roll. Accordingly, it is possible to detect the mass area of the solid area toner patch after transfer to paper with a toner area coverage (TAC) sensor. The manner of operation of the TAC sensor is described in U.S. Pat. No. 4,553,033 to Hubble III et al., which is hereby incorporated in its entirety into the instant disclosure. Alternatively, it is also possible to detect the solid area density of a toner patch on fused paper with an optical or photographic densitometer.

It is, therefore, evident that there has been provided, in accordance with the present invention, a solid area process control for scavengeless development that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall are within the spirit and broad scope of the appended claims.

We claim:

1. An apparatus for developing a latent image recorded on a surface, including:

a donor member, spaced from the surface in a development zone, for transporting toner particles to the development zone;

a transport member, positioned adjacent said donor member in a loading zone, for transporting developer material comprising carrier granules having toner particles adhering triboelectrically thereto to the loading zone;

means for forming an electrical bias between said transport member and said donor member so as to attract toner particles from the carrier granules to said donor member in the loading zone;

a sensor for detecting density of an image developed on the surface; and a controller, coupled to said sensor, for generating a control signal as a function of detected density, said controller being coupled to said forming means for regulating the electrical bias between said donor member and said transport member.

2. An apparatus according to claim 1, further including a housing defining a chamber for storing a mixture of toner particles and carrier granules therein.

3. An apparatus according to claim 2, wherein said donor member includes a roll mounted at least partially in the chamber of said housing and being adapted to advance toner particles to the development zone.

4. An apparatus according to claim 3, further including an electrode member positioned in the space between the surface and said donor roll and being electrically biased to detach toner particles from said donor roll so as to form a toner powder cloud in the development zone with detached toner particles from the toner cloud developing the image.

5. An apparatus according to claim 4, wherein said transport member includes a magnetic roll mounted in the chamber of said housing and being positioned adjacent to said donor roll, said magnetic roll being adapted to advance developer material to the loading zone.

6. An apparatus according to claim 5, wherein the image developed on the surface includes a solid area density region.

7. An electrophotographic printing machine of the type having a latent image recorded on a photoconductive member with a developer unit developing the latent image, wherein the improvement includes:

a donor member, spaced from the surface in a development zone, for transporting toner particles to the development zone;

a transport member, positioned adjacent said donor member in a loading zone, for transporting developer material comprising carrier granules having toner particles adhering triboelectrically thereto to the loading zone;

means for forming an electrical bias between said transport member and said donor member so as to attract toner particles from the carrier granules to said donor member in the loading zone;

a sensor for detecting density of an image developed on the surface; and a controller, coupled to said sensor, for generating a control signal as a function of detected density, said controller being coupled to said forming means for regulating the electrical bias between said donor member and said transport member.

8. An electrophotographic printing machine according to claim 7, including a housing defining a chamber for storing a mixture of toner particles and carrier granules therein.

9. An electrophotographic printing machine according to claim 8, wherein said donor member includes a roll mounted at least partially in the chamber of said housing and being adapted to advance toner particles to the development zone.

10. An electrophotographic printing machine according to claim 9, further including an electrode member positioned in the space between the surface and said donor roll and being electrically biased to detach toner particles from said donor roll so as to form a toner powder cloud in the development zone with detached toner particles from the toner cloud developing the image.

11. An electrophotographic printing machine according to claim 10, wherein said transport member includes a magnetic roll mounted in the chamber of said housing and being positioned adjacent to said donor roll, said magnetic roll being adapted to advance developer material to the loading zone.

12. An electrophotographic printing machine according to claim 11, wherein the image developed on the surface includes a solid area density region.

13. A method for developing a latent image recorded on a surface, including:

transporting toner particles to a development zone with a donor member, spaced from the surface in the development zone;

transporting developer material comprising carrier granules having toner particles adhering triboelectrically thereto to a loading zone with a transport member, positioned adjacent said donor member in the loading zone;

forming an electrical bias between said transport member and said donor member so as to attract toner particles from the carrier granules to said donor member in the loading zone;

sensing a density of an image developed on the surface; and generating a control signal as a function of the density sensed for regulating the electrical bias between the donor member and the transport member.

14. A method according to claim 13, further including storing a mixture of toner particles and carrier granules in a housing defining a chamber.

15. A method according to claim 14, further including advancing toner particles to the development zone with the donor member.

16. A method according to claim 15, further including electrically biasing an electrode member positioned in the development zone to detach toner particles from the donor member so as to form a toner powder cloud in the development zone with detached toner particles from the toner cloud developing the image.

17. A method according to claim 13, further including advancing developer material to a loading zone with the transport member so that toner particles are attracted from the transport member to the donor member.

* * * * *